US006834629B2

(12) United States Patent
Saiki et al.

(10) Patent No.: US 6,834,629 B2
(45) Date of Patent: Dec. 28, 2004

(54) THREE DIMENSIONAL CAM, GRINDING METHOD AND GRINDING APPARATUS

(75) Inventors: Yuji Saiki, Iwata (JP); Naoki Tsuchida, Iwata (JP); Mitsuo Tsuchiya, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 8 days.

(21) Appl. No.: 10/170,256

(22) Filed: Jun. 12, 2002

(65) Prior Publication Data

US 2002/0187734 A1 Dec. 12, 2002

(30) Foreign Application Priority Data

Jun. 12, 2001 (JP) ..... 2001-176881

(51) Int. Cl.[7] ..... F01L 1/04

(52) U.S. Cl. ..... 123/90.6; 123/90.17; 123/90.18; 123/90.34; 74/567; 29/888.1

(58) Field of Search ..... 123/90.6, 90.17, 123/90.27, 90.31, 90.18; 74/567, 568 R, 569; 451/62; 29/888.1; 384/286–293

(56) References Cited

U.S. PATENT DOCUMENTS

| | | | | |
|---|---|---|---|---|
| 3,618,573 A | * | 11/1971 | Allen | 123/90.18 |
| 4,635,592 A | | 1/1987 | Weichsler | 123/90.18 |
| 5,012,783 A | | 5/1991 | Ferrazzi | 123/432 |
| 5,630,953 A | * | 5/1997 | Klink | 219/121.69 |
| 5,921,210 A | | 7/1999 | Regueiro | 123/90.22 |
| 5,988,128 A | | 11/1999 | Moriya et al. | 123/90.18 |
| 6,170,449 B1 | * | 1/2001 | Saiki et al. | 123/90.22 |
| 6,467,166 B1 | * | 10/2002 | Saiki et al. | 29/888.1 |

FOREIGN PATENT DOCUMENTS

| | | | | |
|---|---|---|---|---|
| DE | 34 44 901 A | | 6/1986 | F01L/1/08 |
| EP | 0 930 421 A | | 7/1999 | F01L/1/26 |
| EP | 990774 A1 | * | 4/2000 | F01L/1/26 |

OTHER PUBLICATIONS

Patent Abstracts of Japan, vol. 1999, No. 11, Sep. 30, 1999 & JP 11 165248 A (Toyota Motor Corp), Jun. 22, 1999.
European Search Report dated Jan. 18, 2000.

* cited by examiner

*Primary Examiner*—Thomas Denion
*Assistant Examiner*—Kyle M. Riddle
(74) *Attorney, Agent, or Firm*—Ernest A Beutler

(57) ABSTRACT

An improved cam and follower arrangement suitable for actuating, for example, poppet valves of an internal combustion engine and method and apparatus for forming the cam surface. This permits the use of skewed valve axes without using multiple rocker arms for each valve. The shapes are chosen and formed to provide better contact area and permits the cams to be ground with conventional grinding methods and for multi-cylinder engines.

10 Claims, 6 Drawing Sheets

THREE DIMENSIONAL CAM, GRINDING METHOD AND GRINDING APPARATUS

BACKGROUND OF THE INVENTION

This invention relates to a three-dimensional cam, a method for forming such a cam and a grinding apparatus for grinding the cam face of the three-dimensional cam. The cam, method and apparatus are intended particularly for use to operate a cam follower obliquely to the moving direction of a cam face for operating one or more valves associated with a cylinder of an internal combustion engine.

Such a valve operating system is shown in Japanese Published Application JP-A-Hei 12-170881 and corresponding U.S. Pat. No. 6,170,449, entitled "VALVE OPERATING SYSTEM FOR ENGINE", issued Jan. 9, 2001 and assigned to the assignee hereof. The arrangement there shown provides an optimum combustion chamber configuration and valve placement where plural valves for a single cylinder can be positioned and operated, each by a single cam and rocker arm follower. However certain improvements are desired in that arrangement and the method and apparatus for forming the operating cam surfaces.

Specifically, the cam face is ground in such a manner that the axis of the grinding wheel is slanted in relation to the axis of the three-dimensional cam. The grinding wheel is moved along the cam profile in the radial direction of the cam while the three-dimensional cam is rotated about its axis at a low speed. The grinding wheel is of a disk-shape with a radius of curvature the same as that of the follower surface. The grinding is performed with the cylindrical outside circumferential surface of the grinding wheel brought into line contact with the cam face in the axial direction over the entire surface of the cam face.

With the resulting three-dimensional cam, a phenomenon might occur that the desired line contact line between the cam surface and the slipper surface is not perfect. Thus a gap is formed after grinding between the cam face and the engaged surface of the follower. This results in a larger contact pressure, which causes abrasion and/or insufficient lubrication. This is more likely if the diameter of the grinding wheel used for grinding is not equal to or smaller than the follower surface.

In addition, since the axis of the grinding wheel is slanted in relation to that of the camshaft during grinding, the length of the camshaft which can be ground on the grinding machine is necessarily limited. This must be done to avoid interference between the camshaft and the grinding machine. Thus only three-dimensional cams for single cylinder engines can be ground on the conventional grinding machine.

It is therefore a principle object of this invention to provide a three-dimensional cam surface that provides sufficient lubrication and avoids high contact pressures as well as a method and apparatus for forming such cam surfaces.

It is another object of this invention to provide a valve operating system utilizing a three-dimensional cam that provides sufficient lubrication and avoids high contact pressures as well as a method and apparatus for forming such a valve operating system.

It is a further object of this invention is to provide a three-dimensional cam grinding machine and method for manufacturing a camshaft for a multi-cylinder engine with a three-dimensional cam.

SUMMARY OF THE INVENTION

A first feature of this invention is adapted to be embodied in a three-dimensional cam rotatable about a cam axis for operating a cam follower pivotal about an axis disposed obliquely to the cam axis. The three dimensional cam has an operating face formed with a series of regularly arranged recesses.

A second feature of the invention is adapted to be embodied in an engine valve operating system utilizing such a cam to operate a poppet valve through a respective rocker arm having a follower surface engaged with the cam lobe for pivoting the rocker arm about a pivot axis that is disposed at a skewed angle to the axis of rotation of a camshaft carrying the cam. The rocker arm has an actuating surface engaged with the poppet valve. The poppet valve reciprocates about an axis that is skewed relative to the camshaft rotational axis and which lies in a plane that is generally perpendicular the respective rocker arm pivot axis.

A third feature of the invention is adapted to be embodied in a grinding machine for grinding a three-dimensional slightly concave cam surface. The grinding machine comprises a grinding wheel having a rotational axis and a grinding surface formed by a convex curved surface. The convex curved surface has a radius of curvature smaller than the concave cam surface of the cam. A grinding wheel drive rotates the grinding wheel about its rotational axis and the rotational axis of the grinding wheel is translated based on a target cam profile and a target shape of the cam surface face set for each given rotation angle of the cam. This translation grinds the cam surface along a grinding point that is moved in the rotational and axial directions while maintaining a normal vector of the grinding wheel in coincidence with a normal vector of the desired cam surface.

A fourth feature of the invention is adapted to be embodied in a method of grinding a three-dimensional slightly concave cam surface. This method utilizes a grinding wheel having a rotational axis and a grinding surface formed by a convex curved surface having a radius of curvature smaller than the concave cam surface of the cam. The method comprises the steps of rotating the grinding wheel about its rotational axis and translating the rotational axis of the grinding wheel based on a target cam profile and a target shape of the cam surface face set for each given rotation angle of the cam. This translation grinds the cam surface along a grinding point that is moved in the rotational and axial directions while maintaining a normal vector of the grinding wheel in coincidence with a normal vector of the desired cam surface.

DETAILED DESCRIPTION

Figure 1:
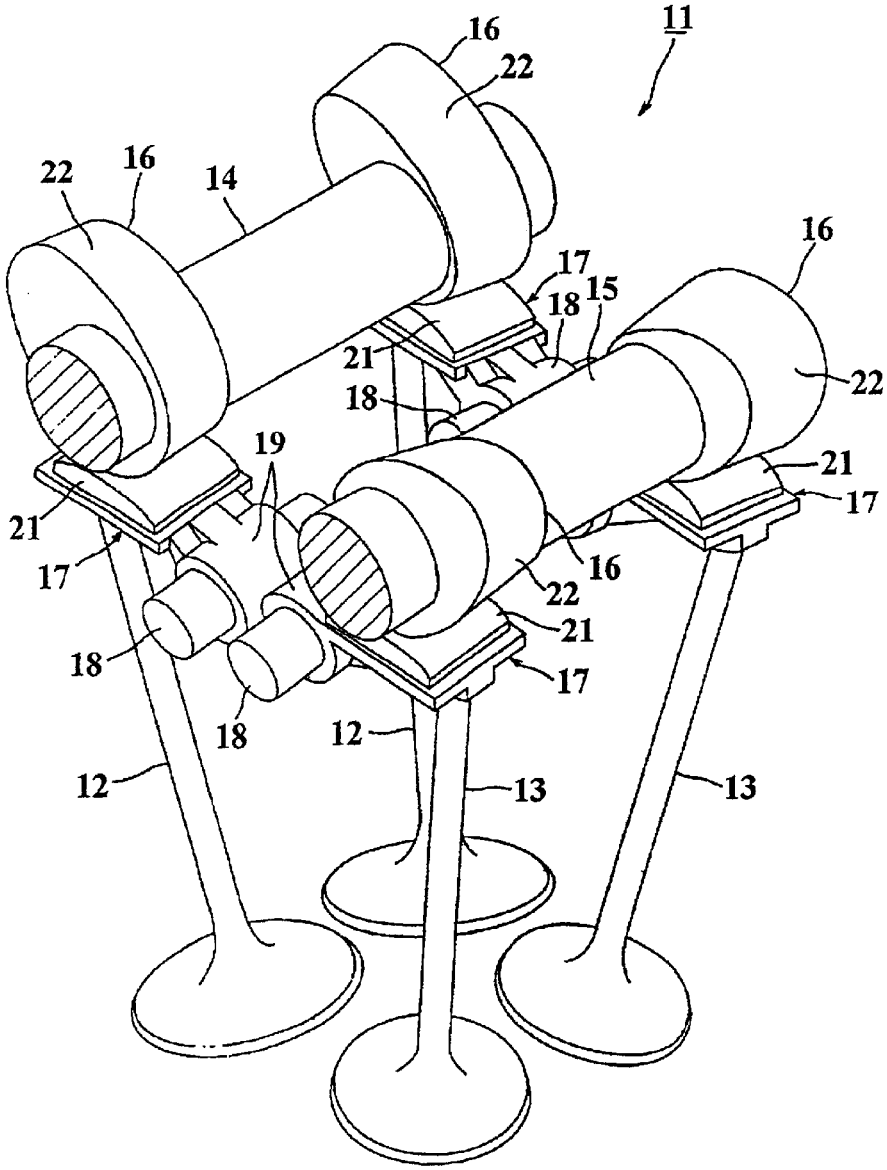
FIG. 1 is an enlarged perspective view of an internal combustion cylinder head area showing only the valves and the operating mechanism therefore which embodies the invention.
Figure 2:
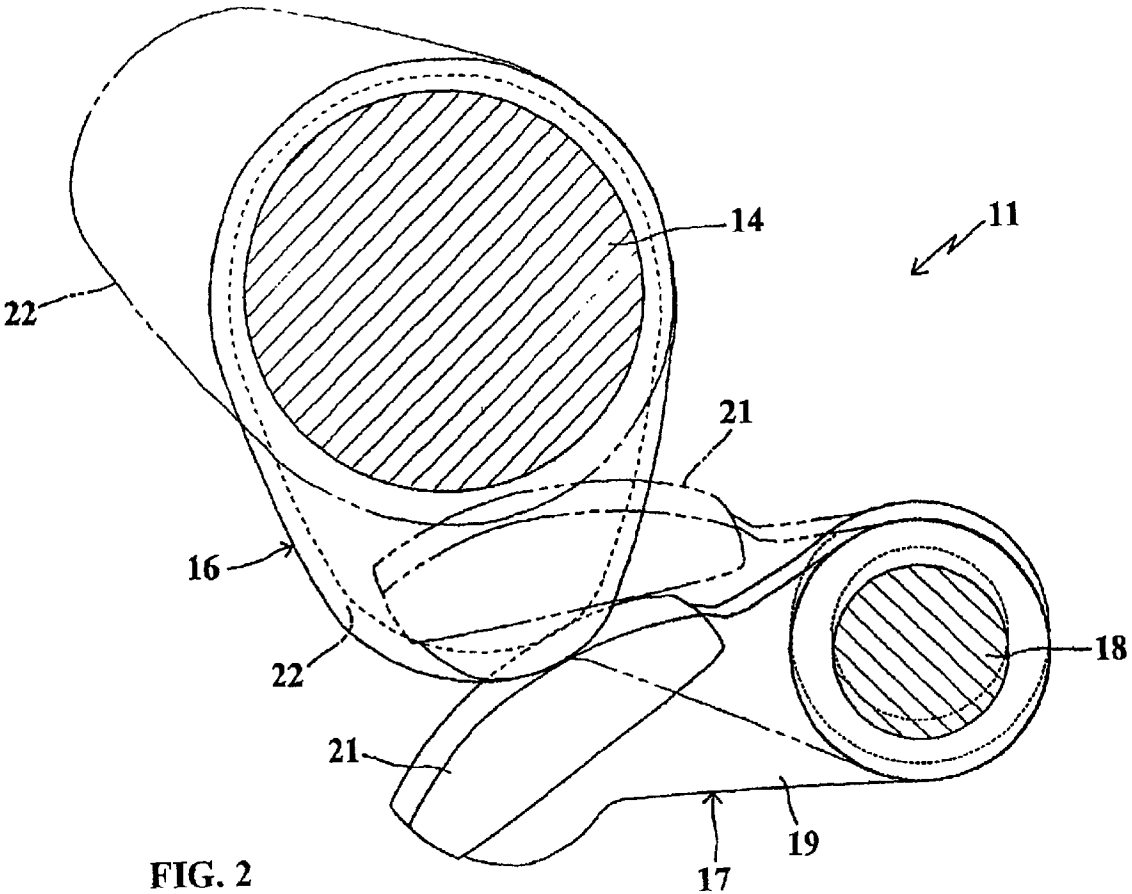
FIG. 2 is an enlarged view showing the valve operating mechanism associated with one of the valves. The solid line view shows the position when the valve is fully opened and the phantom line shows the position when the valve is fully closed.

Referring now in detail to the drawings and initially to FIGS. 1 and 2, a valve operating system for an internal combustion engine constructed and formed in accordance with the invention is identified generally by the reference numeral 11. The structure of the associated engine may be of the type described in the aforenoted U.S. Pat. No. 6,170,449 and the drawings of this case correspond primarily to FIGS. 3 and 7 of that earlier application. Reference may be had to that patent for details of the associated engine components which may be of any conventional type and which do not constitute a part of the invention.

Basically, the construction is comprised of a pair of intake poppet type valves 12 that are supported for reciprocation in the cylinder head assembly and which valve intake ports that communicate with the combustion chambers of the engine. These intake valves 12 are disposed so that their reciprocal axes are skewed to the cylinder bore axis although they may in fact intersect it. These axes lie on one side of a plane containing the cylinder bore axis and the output shaft of the engine.

Poppet type exhaust valves 13 are disposed on the opposite side of this plane and control the flow through exhaust ports which also are not shown but which may be of the type described in the aforenoted patent specification.

An intake camshaft 14 is rotatably journalled in the cylinder head assembly in a suitable manner and is driven from the engine output shaft through a suitable transmission at one half crankshaft speed. In a like manner, an exhaust camshaft 15 is journalled in the cylinder head assembly on the opposite side of the aforenoted plane containing the cylinder bore axis. Each of the intake and exhaust camshafts 14 and 15 have individual cam lobes 16 formed at spaced locations along their length and which are ground to a configuration as will be described and by the method and apparatus to be described, by reference to the later figures.

Each of the cam lobes 16 cooperates with a rocker type follower mechanism, indicated generally by the reference numeral 17 and which are supported for pivotal movement about skewed axes by rocker arm pivot shafts 18, again mounted in the cylinder head assembly in the manner described in the aforenoted patent specification.

These rocker followers 17 are comprised of main rocker arm portions 19 that provide the journals on the rocker shaft 17 and which carry slipper followers 21 that are engaged by the cam surfaces 22 of the respective cam lobes 16.

Figure 3:
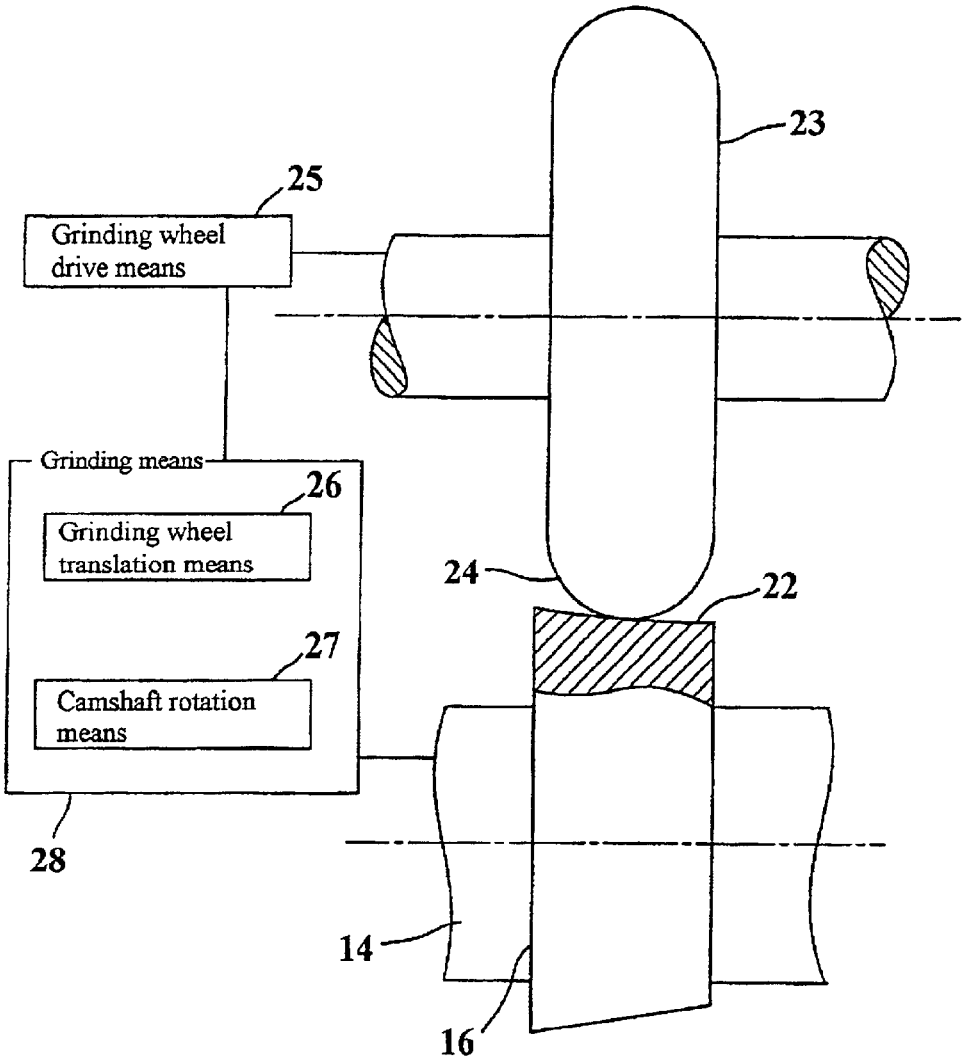
FIG. 3 is a partially schematic view looking perpendicularly to the camshaft axis and showing the grinding apparatus and method.
Figure 4:
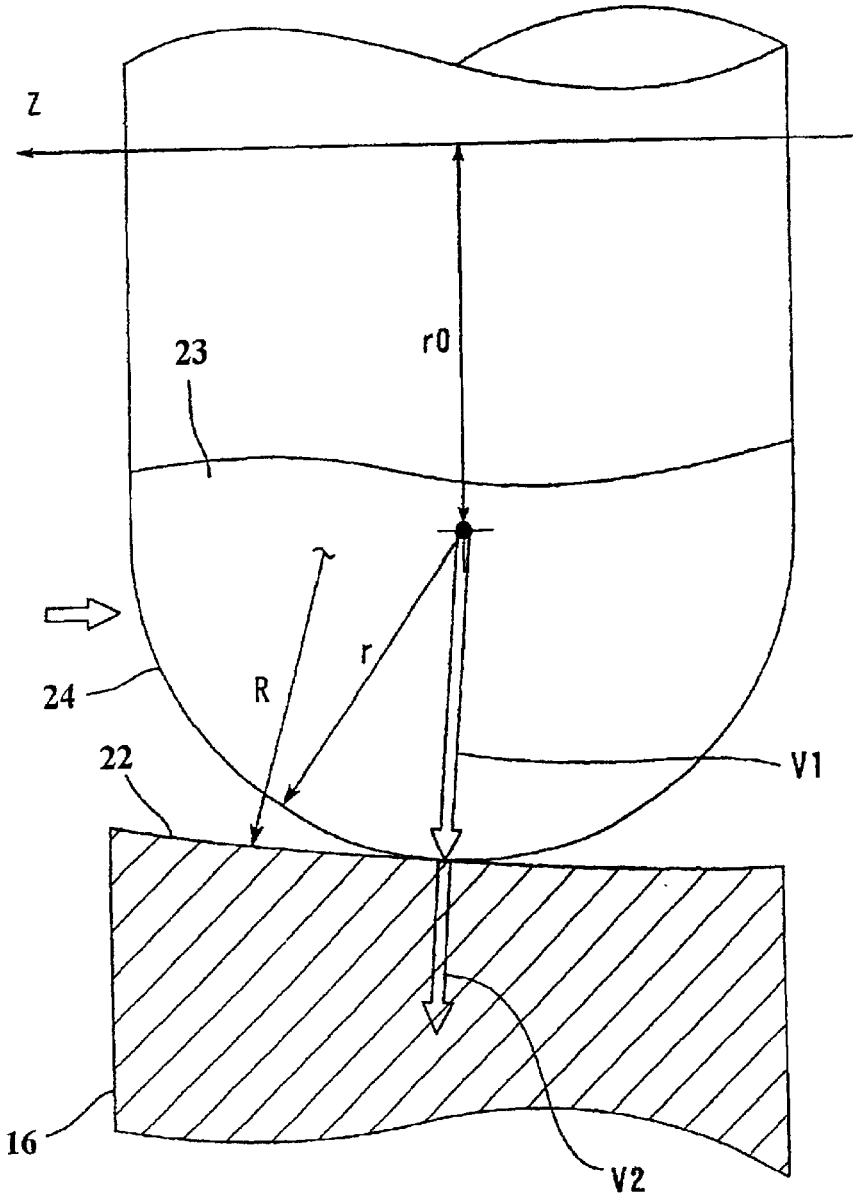
FIG. 4 is an enlarged view looking in the same direction as FIG. 3 and shows the geometrical relations between the grinding wheel and the ground cam surface.

The three-dimensional cam 16, as shown in FIG. 3 and FIG. 4, has its cam face 22 inclined so that it decreases its diameter gradually in the axial direction from one end (left side end in FIGS. 3 and 4) to the other end. As seen in these figures, the cam face 22 has a radially inwardly concave curved face surface 22.

In this embodiment, the cam face 22 is ground with a disk-like grinding wheel 23 into the desired shape. A grinding surface 24 of the grinding wheel 23 has a convex curved surface with a radius of curvature "r" smaller than the radius of curvature "R" of the concave portion of the cam face 22.

The grinding machine that includes the grinding wheel 23 is depicted schematically in FIG. 3 and comprises a grinding wheel drive 25 for rotating the grinding wheel 23 at high speed, a grinding wheel translation section 26 for moving the grinding wheel 23 both radially and axially relative to its and the axis of the camshaft 14, and camshaft rotation drive 27 for rotating the camshafts 14, 15 to be ground at low speed to move the grinding point of the grinding wheel 23 circumferentially around the camshafts 14 and 15 and specifically their cam faces 22. The grinding wheel moving translation section 26 and the camshaft rotation drive 27 constitute a grinding arrangement, indicated generally at 28.

The grinding arrangement 28 is arranged such that the cam face 22 is ground by the grinding wheel 23 in accordance with a target cam profile of the three-dimensional cam 16. The target shape of the cam face 22 is determined for each given rotation angle of the three-dimensional cam 16. Specifically, grinding is performed as shown in FIG. 4 such that the grinding point is moved in the rotational and axial directions of the three-dimensional cam 16 while a normal vector V1 of the grinding wheel 23 at each grinding portion is kept in coincidence with a normal vector V2 of the target shape of the cam face 22. This grinding action also creates ground marks each consisting of a minute recess in the cam face 22. These ground marks are arranged in circumferentially extending, regularly and axially spaced rows on the cam face 22 of the three-dimensional cam 16.

Figure 5:
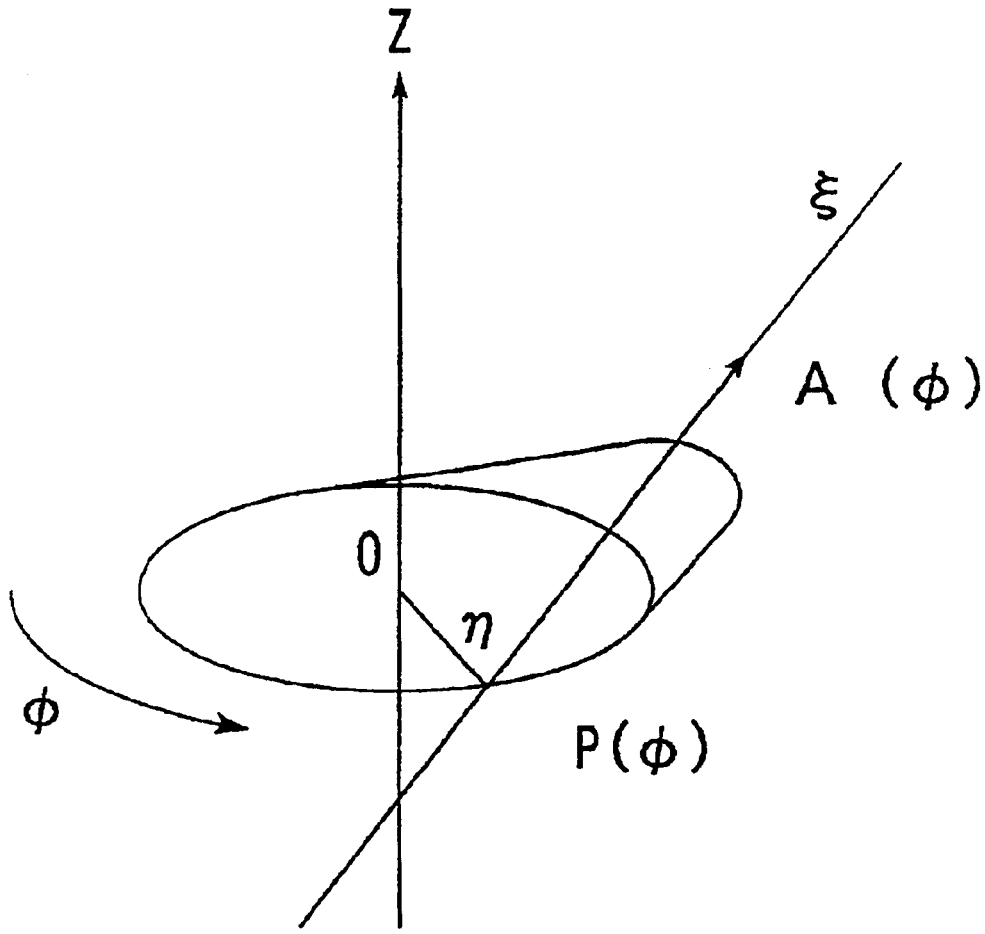
FIG. 5 is a graphical view showing the locus of the follower surface.

The procedure of determining the target shape of the cam face 22 will be described by referring to FIGS. 5 and 6. The following is based on the supposition of a coordinate system in which the three-dimensional cam 16 is fixed and the slipper 21 and rocker arm 17 rotate as a unit around the camshaft. An enveloping surface of the cam rotation angle with respect to the slipper and rocker arm axis constitutes the cam face 22.

If the position of the center line of the slipper 21 for each cam rotation angle is determined successively, the locus forms a curved surface. Since the center line is a straight line, a velocity vector and a normal vector of the locus surface can be calculated easily compared with an ordinary free curved surface. The curved surface constituted by the locus of the center line of the slipper 21 is referred to as a "slipper center line locus surface". Since the slipper center line locus surface is one that is formed by sweeping a straight line, it has the feature of a ruled surface.

Since the slipper 21 is of a cylindrical shape, determining the enveloping surface with respect to the slipper cylinder is done by offsetting the slipper center line locus surface by the radius of the slipper 21. A velocity vector and a normal vector of the offset surface inherit the properties of the original surface such as the velocity vector and the normal vector, so that they can be calculated easily even if direct calculation is impossible. That is, if the velocity vector of the slipper center line for each cam rotation angle and the cam thrust position are established, the contact point between the slipper 21 and the three-dimensional cam 16 can be calculated uniquely.

Next will be described the determination of the slipper center line locus surface by reference to FIG. 5. The slipper center point at a cam rotation angle $\phi$ is identified as $P(\phi)$, and a unit vector in the direction of the slipper center axis is designated $A(\phi)$. The slipper center line locus surface $S(\phi, \xi)$ is defined as follows $$S(\phi, \xi)=P(\phi)+\xi A(\phi) \tag{1}$$

where $\xi$ is the amount of movement in the direction of the slipper center axis. Thus, tangent vectors $S\phi$, $S\xi$ of the curved surface can be expressed as follows:

$$S\phi=dS/d\phi=dP/d\phi+\xi(dA/d\phi)=P\phi+\xi A\phi$$

$$S\xi=dS/d\xi=A \tag{2}$$

Figure 6:
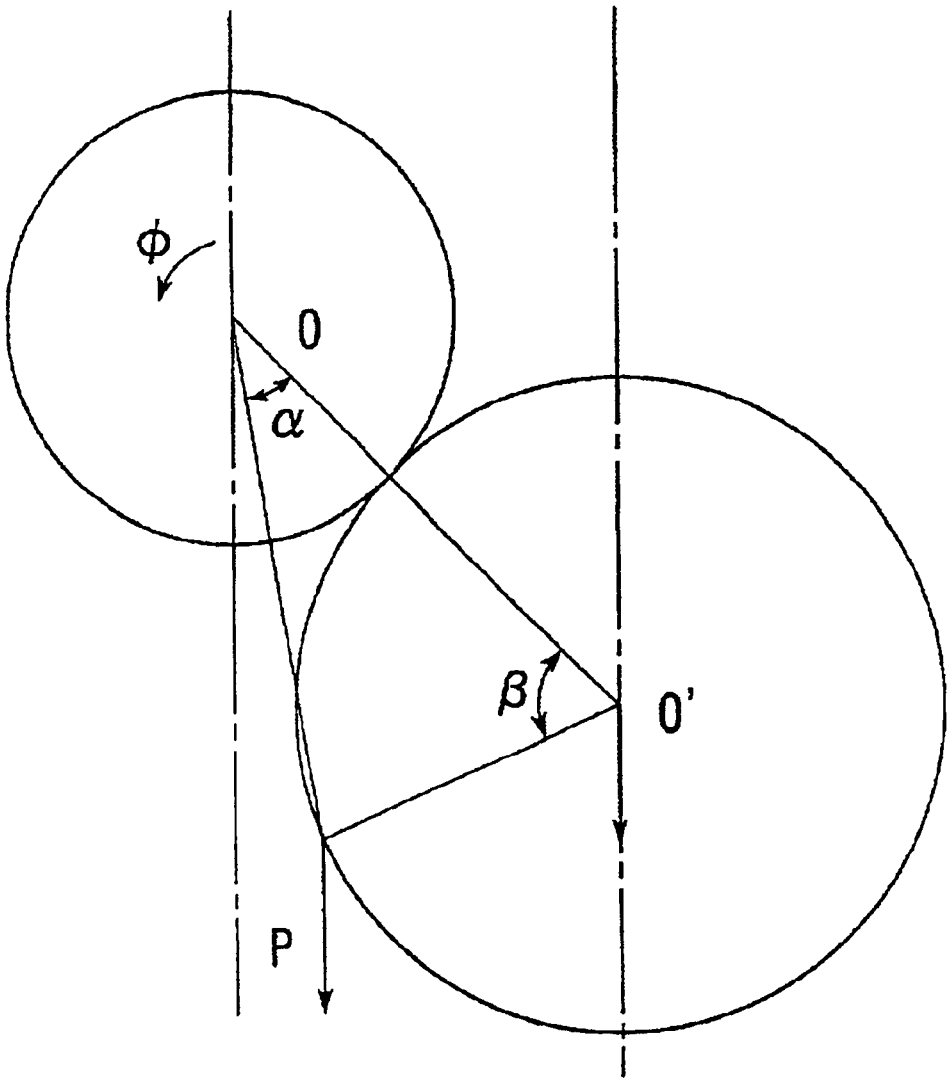
FIG. 6 is a view looking in the direction of the camshaft axis and shows the relation to the rocker arm axis.

$P\phi$ is represented by the following expression as the resultant of the velocity of the rocker arm 17 moving around the camshaft 14, 15 at a constant speed, and the center velocity of the slipper 21 rotating around the rocker shaft 18, using a rocker center line unit vector Z' and a rocker center point O' (FIG. 6).

FIG. 6, as has been noted, is a drawing as viewed in the axial direction of the camshaft, and the Z-axis is on the point O. The direction of the Z'-axis coincides with an A vector. In FIG. 6, if with the camshaft taken as a reference line, the rocker shaft and the slipper 21 shaft are slanted by $\delta°$ in the direction of a right hand screw around the X-axis the following hold:

Z: unit vector in the direction of the camshaft=(0, 0, 1),

O: direction of the cam center axis=(0, 0, 0),

O': rocker center point,

Z': unit vector in the direction of the rocker shaft=(0, −sin $\delta$, cos $\delta$), P: slipper center point, and Z': unit vector in the direction of the slipper shaft=(0, −sin $\delta$, cos $\delta$).

$$P\phi=dP/d\phi=Z\times P+(d\beta/d\phi)Z'\times(P-O') \tag{3}$$

$A\phi=dA/d\phi=Z\times A$, where symbol $\times$ represents the vector product.

Since a normal direction is given as the vector product of the velocity vector of the curved surface, a unit normal vector is written as:

$$N(\phi, \xi)=S\phi\times S\xi/\square S\phi\times S\xi\square$$

The surface of the three-dimensional cam 16 has the shape of the slipper center line locus surface offset by the radius r of the slipper 21. The cam face 22($\phi$, $\xi$) can be represented by the following expression (4) using the slipper center line locus surface $S(\phi, \xi)$ and a normal vector $N(\phi, \xi)$. The position, the velocity vector and the second order differential vector of the cam face 22 (offset surface) can all be determined from the position, the velocity vector and the normal vector of the original surface (slipper center line locus surface).

$$C(\phi, \xi)=S(\phi, \xi)+r\,N(\phi, \xi)$$

$$C\phi=dC/d\phi=dS/d\phi+r(dN/d\phi)$$

$$C\xi=dC/d\xi\phi=dS/d\xi+r(dN/d\xi)$$

$$C\phi\phi=d^2C/d\phi^2+r(d^2N/d\phi^2) \tag{4}$$

$$C\phi\xi=d^2C/d\phi d\xi=d^2S/d\phi d\xi+r(d^2N/d\phi d\xi)$$

$$C\xi\xi N=d^2C/d\xi^2=d^2S/d\xi^2+r(d^2N/d\xi^2)$$

$N\phi$, $N\xi$, $N\phi\phi$, $N\phi\xi$ and $N\xi\xi$ can be calculated using the first fundamental quantities E, F, and G and the second fundamental quantities l, m, and n of the curved surface as follows.

While the first fundamental quantities are expressed in capital letters, the second fundamental quantities are expressed in lower-case letters to be distinguished from the normal vector N. The expression of the partial differential of a unit normal vector by a linear combination of the tangent vector is called "the equation of Weingarten". Unless the differential value of the original surface unit normal vector is zero, the tangent vector of the offset surface differs from that of the original surface. This is because the Z-axis is not parallel to the Z'-axis in the present three-dimensional cam 16.

$$E=S\phi S\phi,\ F=S\phi S\xi,\ G=S\xi S\xi$$

$$l=S\phi\phi N,\ m=S\phi\xi N,\ n=S\xi\xi N$$

$$N\phi=dN/d\phi=(mF-lG)/(EG-F^2)S\phi+(lF-mE)/(EG-F^2)S\xi \tag{5}$$

$$N\xi=dN/d\xi=(nF-mG)/(EG-F^2)S\phi+(mF-nE)/(EG-F^2)S\xi$$

Although properties of the offset surface inherit those of the original surface, calculation of the position of the offset surface necessitates information on the position and the tangent vector of the original surface. Calculation of the tangent vector of the offset surface necessitates information of a higher class such as the position, the tangent vector and the second order differential vector of the original surface.

The contact point with the grinding wheel can be obtained by successive calculations of the position, the tangent vector and the second order differential vector utilizing the foregoing properties. However, direct production of the cam face 22 is advantageous to design review or comparison with the inspection data. Thus, present calculation is performed of points on the cam curved surface for every angle of 1° and for every thrust direction of 1°, producing 36 drawings of the twin cubic surface of continuous curvature (one drawing/ten degrees).

A free fitting method in which passing points are specified, is used as an interpolation of the curved surface. Although a vector at a specified point can be calculated using the original surface, breakage will occur unless tangent vector ratios at adjacent points are matched to each other. The free fitting method in which tangent vector ratios are matched to each other and passing points are specified, is used to dispense with special post-processing. Although error develops in a rising section where change in curvature is discontinuous, no problem is raised because accuracy check at the time of inspection data preparation showed that the error was 0.1 $\mu$m or less.

Placement of the intermediate cam curved surface allows the calculation of positions and normal lines to be performed directly from the cam curved surface, and contact point calculation and the valve layout can be treated separately without need of taking account of the valve layout and the position of the rocker arm 17 in the calculation of positions of the grinding wheel and the measurement piece. In the case of a radial cam, as in a flat cam, the position for each specified angle can be solved as a contact problem between the cam and the grinding wheel and measurement piece. In the radial cam, however, since there is a change in the thrust direction, the situation is different from the flat cam in which preparation of grinding and measurement data is needed only for one cycle.

The grinding wheel 23 used in this embodiment is of a so-called doughnut type. Specifically, it has a shape produced when a circle of radius r at a location offset by rO from the Z-axis is revolved around the Z-axis. If $E_z$ represents the rotation matrix around the Z-axis and $e_i$ represents a unit vector in the direction of each axis, the shape of the grinding wheel 23 can be written as:

$$T(\theta,\omega)=E_z^i\omega\{r(e_x \cos\theta+e_z \sin\theta)+rOe_x\}$$

This means that the contact position between the three-dimensional cam 16 and the grinding wheel 23 at a specified thrust position and for a specified angle from the cam center line is calculated. Under the restriction of equations T(θ,ω) $\square_z$=specified thrust position, and $$ATAN2\{T(\theta,\omega)\ \square_y T\ (\theta,\omega)\square_x=\text{specified angle},$$

$$L=\{T(\theta,\omega)\ \square_x{}^{}2+T\ (\theta,\omega)\ \square_y{}^{}2\}^{1/2}.$$

In the actual calculation, there is no need of finding the contact point between the cam 22 and the doughnut shape 24 if only the contact point between the cam and the sphere at the top end is calculated, and the center of the doughnut shape, if required, can be obtained easily by two-dimensional calculation.

Therefore, since the three-dimensional cam 16 shaped by the foregoing grinding procedure has multiple grinding marks each constituted by a minute recess formed in the cam face 22, arranged regularly in rows in the rotational and axial directions of the cam, respectively, the height of minute grooves formed by a plurality of grinding marks can be made smaller than the thickness of the lubricating oil film, so that cam load can be supported on the entire contact width. As a result, since continuous oil film is formed between the three-dimensional cam 16 and the slipper 21, providing a three-dimensional cam free from insufficient lubrication.

In addition, in the three-dimensional cam grinding machine of this invention, grinding is performed with a grinding point moved in the rotational and axial directions while a normal vector of the grinding wheel 23 at the grinding portion is kept in coincidence with a normal vector of the target cam face 22. Therefore, the axis of the grinding wheel 23 can be made parallel to that of the camshaft 14, 15, providing machining on a more ordinary grinding machine. Thus, no restriction due to interference with the grinding machine is placed on the axial length of the camshaft, so that camshafts for multi-cylinder engines can be manufactured.

Of course, the foregoing description is that of a preferred embodiment of the invention and various changes and modifications may be made without departing from the spirit and scope of the invention, as defined by the appended claims.

What is claimed is:

1. A three-dimensional cam rotatable about a cam axis for operating a cam follower pivotal about an axis disposed obliquely to said cam axis, said three dimensional cam having an operating face formed with a series of regularly arranged nonintersecting minute recesses.

2. A three-dimensional cam as set forth in claim 1 wherein the recesses are circumferentially extending in regularly and axially spaced rows.

3. A three-dimensional cam as set forth in claim 1 wherein the cam operating face is configured with a slight concavity so as to maintain a line contact with the cam follower.

4. A three-dimensional cam as set forth in claim 1 wherein the recesses have a depth less than that of the thickness of an oil film disposed between the operating face and the cam follower.

5. A three-dimensional cam as set forth in claim 4 wherein the cam operating face is configured with a slight concavity so as to maintain a line contact with the cam follower.

6. A three-dimensional cam as set forth in claim 1 in combination with an internal combustion engine wherein the cam operates a poppet valve through a respective rocker arm having a follower surface engaged with said cam lobe for pivoting said rocker arm about a pivotal axis that is disposed at a skewed angle to the axis of rotation of a camshaft carrying said cam, said rocker arm having an actuating surface engaged with said poppet valve that reciprocates about an axis that is skewed relative to said camshaft rotational axis and which lies in a plane that is generally perpendicular the respective rocker arm pivot axis.

7. The combination of claim 6 wherein the recesses are circumferentially extending in regularly and axially spaced rows.

8. The combination of claim 7 wherein cam operating face is configured with a slight concavity so as to maintain a line contact with the rocker arm follower surface.

9. The combination of claim 7 wherein the recesses have a depth less than that of the thickness of an oil film disposed between the operating face and the rocker arm follower surface.

10. The combination of claim 9 wherein the cam operating face is configured with a slight concavity so as to maintain a line contact with the rocker arm follower.

* * * * *